8/11/87 OR 4,685,413

United States Patent [19]

Foreman

[11] Patent Number: 4,685,413

[45] Date of Patent: Aug. 11, 1987

[54] TANDEM WATER SKI TOWING DEVICE

[76] Inventor: Dennis Foreman, R.R. 3, Box 15, Fairland, Ind. 46126

[21] Appl. No.: 843,122

[22] Filed: Mar. 24, 1986

Related U.S. Application Data

[63] Continuation of Ser. No. 515,457, Jul. 20, 1983, Pat. No. 4,579,075.

[51] Int. Cl.[4] ..... B63B 21/56

[52] U.S. Cl. ..... 114/253; 441/68

[58] Field of Search ..... 114/242, 249, 253, 254; 441/68, 69, 73; 280/480; 24/115 R, 119, 128, 305, 343

[56] References Cited

U.S. PATENT DOCUMENTS

| | | | |
|---|---|---|---|
| 2,318,150 | 5/1943 | Foss | 114/253 |
| 2,536,118 | 1/1951 | Armstrong | 24/128 R |
| 2,555,663 | 6/1951 | Schouboe | 280/480 |
| 2,764,118 | 9/1956 | Madison | 114/253 |
| 2,943,591 | 7/1960 | Schneider | 114/253 |
| 3,294,053 | 8/1965 | Emery | 114/235 |
| 3,353,232 | 11/1967 | Brownson | 114/253 |
| 4,213,413 | 7/1980 | Courtney | 24/128 R |

FOREIGN PATENT DOCUMENTS 6467 of 1909 United Kingdom ..... 24/128 R

OTHER PUBLICATIONS

Lewis Marine Supply, Inc., Fort Lauderdale, Fl. 1982 (3/10/82), p. 317.

*Primary Examiner*—Joseph F. Peters, Jr.
*Assistant Examiner*—Stephen P. Avila
*Attorney, Agent, or Firm*—Woodard, Emhardt, Naughton Moriarty & McNett

[57] ABSTRACT

A tandem towing device for towing a pair of water skiers with one boat has a hook for attachment to a boat, a plate rotatably mounted on the shaft of the attachment hook, and a pair of diametrically opposed holes in the plate for attachment to two towlines. The holes receive the towlines through corresponding channels disposed about the perimeter of the plate. The towlines are retained in the holes in the circular plate by sleeves which slide about the towlines and into the holes. When the towlines are put in tension by normal use, the plate rotates to eliminate any tangling of the lines which may exist.

6 Claims, 4 Drawing Figures

TANDEM WATER SKI TOWING DEVICE

This application is a continuation of application Ser. No. 515,457, filed July 20, 1983, now U.S. Pat. No. 4,579,075, issued Apr. 1, 1986.

BACKGROUND OF THE INVENTION

This invention relates to devices for towing water skiers, and particularly to devices for towing more than one water skier from one boat.

Water skiing has long been a popular recreational activity. The enjoyment of water skiing is to be shared and oftentimes skiers ski in pairs. However, tandem skiing poses a problem of constant tangling of the multiple towlines used. Towlines are conventionally either directly attached to some portion of the rear part of the boat or indirectly by an auxiliary attachment line which is, in turn, attached at two places to the rear of the boat. With the lines attached in this manner, tandem skiers executing crossover maneuvers or exchanging lines cause the lines to wrap themselves around one another. Tangling may also occur when the towlines are stored, or when a skier falls into the water, or when the boat is maneuvering to pick up new skiers. Untangling of the towlines is a tedious task.

SUMMARY OF THE INVENTION

While the actual scope of the invention covered herein can be determined only by reference to the claims appended hereto, certain of the features which are relevant to the improved operation of the novel towing device disclosed herein can be described briefly. The towing device according to the present invention permits coupling of two towlines to a single ski boat without the attendant tangling problems associated with conventional tandem skiing. In the preferred embodiment, a circular plate with a pair of diametrically opposed holes is rotatably mounted on the shaft of a locking hook. The hook may be attached to an auxiliary towline attached to the rear of the boat or directly to the boat. The holes receive the towlines through corresponding channels disposed about the perimeter of the plate. The towlines are retained in the holes in the circular plate by sleeves which slide about the towlines and into the holes. When the towlines are put in tension by normal use, the plate rotates to eliminate any tangling of the lines which may exist.

DESCRIPTION OF THE PREFERRED EMBODIMENT

Figure 1:
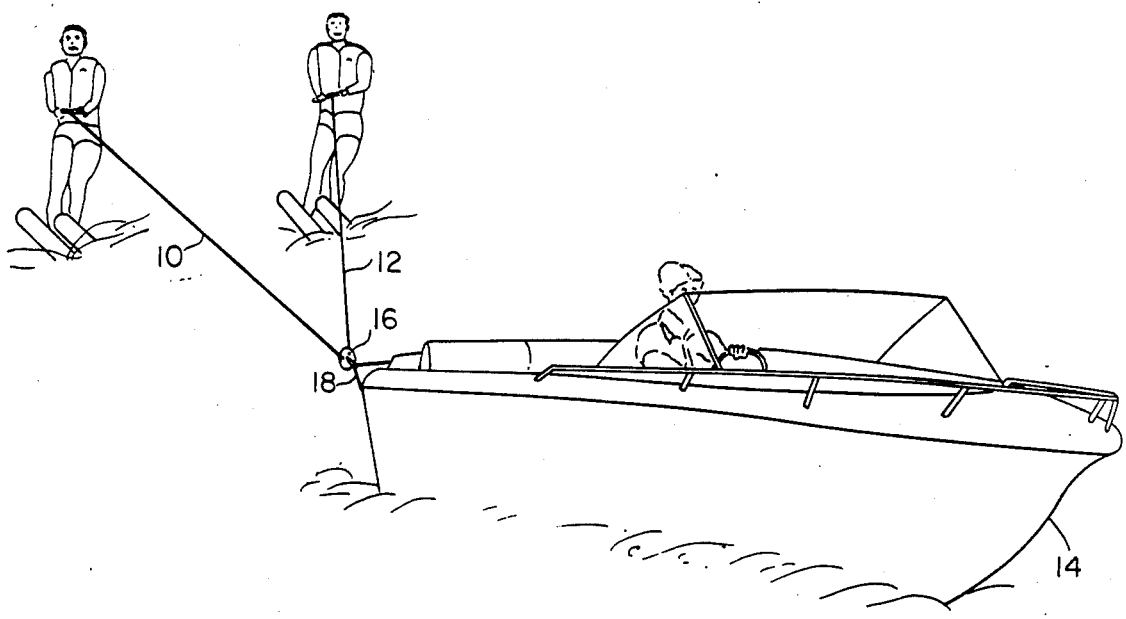
FIG. 1 is a perspective view of a pair of water skiers being towed by a single boat using a towing device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The general operation of the towing device according to the present invention may be understood with reference to FIG. 1. Skiers attached to towlines 10 and 12 are pulled by boat 14 by means of towing device 16 and auxiliary towline 18 attached to boat 14.

Figure 2:
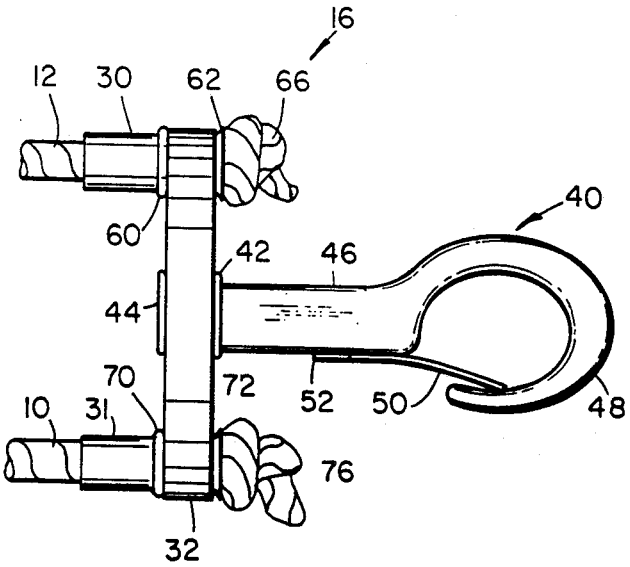
FIG. 2 is a side view of a towing device according to the present invention shown with the terminating ends of two towlines in place.

With reference to FIG. 2, towlines 10 and 12 are shown connected to towing device 16. Towing device 16 includes circular plate 32 coupled to boat attachment hook 40 and sleeves 30 and 31. Boat attachment hook 40 forms the forward portion of towing device 16.

Figure 4:
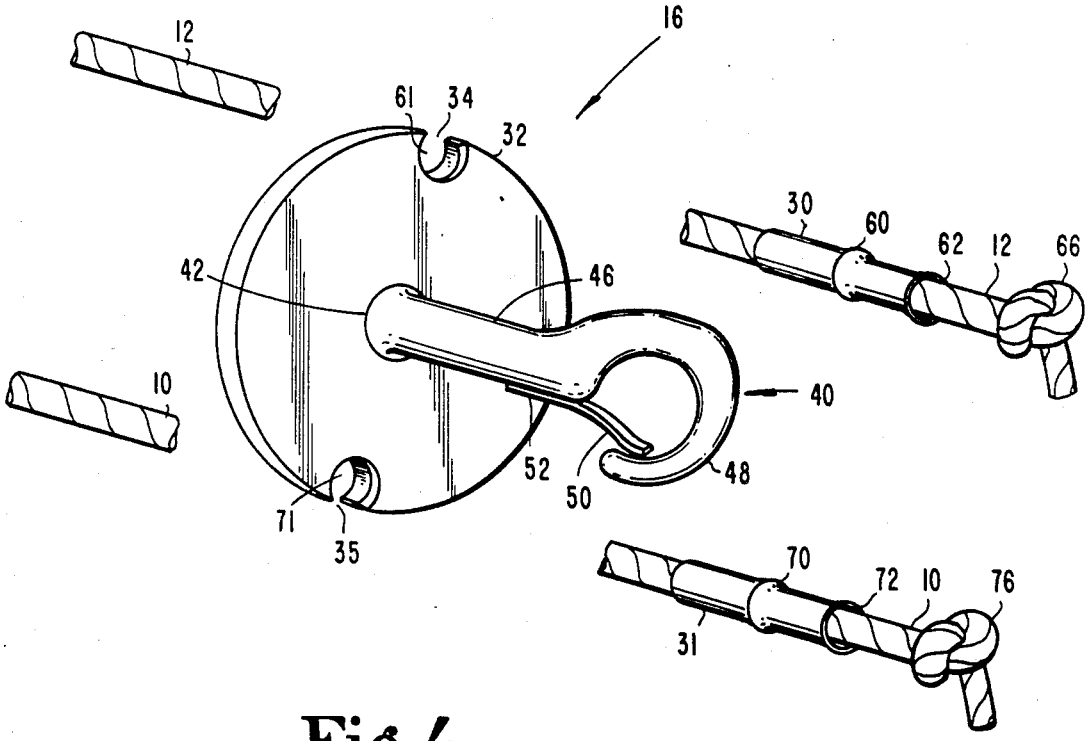
FIG. 4 is an exploded, perspective view of a towing device according to the present invention shown with the terminating ends of two towlines in place.

Referring to FIGS. 2 and 4, sleeve 30 is slidably mounted into hole 61 from the forward side of circular plate 32 and held therein by detent portion 60 formed on sleeve 30. The diameter of hole 61 is larger than the outer diameter of sleeve 30 except for detent portion 60 which normally has a larger diameter than hole 61. Sleeve 30 is formed of a resilient material, preferably nylon, which will permit compression of detent 60 enabling it to pass through hole 61 and provide a snap fit for sleeve 30 in hole 61. Forward end 62 of sleeve 30 is flared to prevent sleeve 30 from passing completely through plate 32, and the forward end of hole 61 in plate 32 is correspondingly flared in shape to provide a seat for flared forward end 62 of sleeve 30. The inner diameter of sleeve 30 is greater than the diameter of towline 12 thereby permitting insertion and rotation of towline 12 therein. Towline 12 is terminated on its forward end by knot 66 in a conventional manner which may, for example, include application of heat to tighten the knot.

Figure 3:
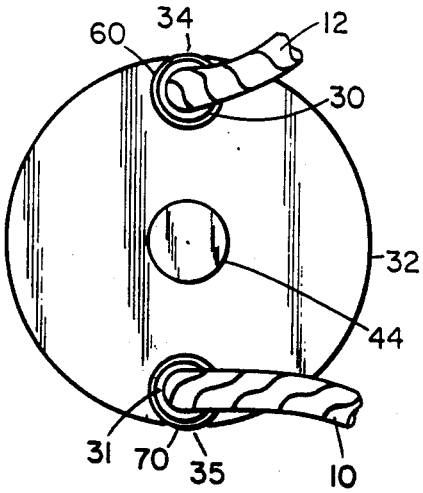
FIG. 3 is a rear view of a towing device according to the present invention shown with portions of two towlines in place.

Circular plate 32 is provided with slot 34 as an opening to hole 61 from the periphery of plate 32, as will be understood with reference to FIGS. 3 and 4. Slot 34 is narrower than sleeve 30.

Similarly, as shown in FIGS. 2 and 4, sleeve 31 is slidably mounted into hole 71 from the forward side of circular plate 32 and held therein by detent portion 70 formed on sleeve 31. The diameter of hole 71 is larger than the outer diameter of sleeve 31 except for detent portion 70 which normally has a larger diameter than hole 71. Sleeve 31 is formed of a resilient material, preferably nylon, which will permit compression of detent 70 enabling it to pass through hole 71 and provide a snap fit for sleeve 31 in hole 71. Forward end 72 of sleeve 31 is flared to prevent sleeve 31 from passing completely through plate 32, and the forward end of hole 71 in plate 32 is correspondingly flared in shape to provide a seat for flared forward end 72 of sleeve 31. The inner diameter of sleeve 31 is greater than the diameter of towline 10 thereby permitting insertion and rotation of towline 10 therein. Towline 10 is terminated on its forward end by knot 76 in the same manner as towline 12.

Circular plate 32 is provided with slot 35 as an opening to hole 71 from the periphery of plate 32, as will be understood with reference to FIGS. 3 and 4. Slot 35 is narrower than sleeve 31.

Returning to FIG. 2, circular plate 32 is rotatably mounted about shaft 46 of boat attachment hook 40 through hole 36 and is retained thereon by forward boss 42 and rearward boss 44. Boat attachment hook 40 is a locking hook, hook portion 48 cooperating with leaf spring 50 to produce a locking action. It will be appreciated that, with leaf spring 50 secured to shaft 46 at point 52 and biased to normally rest against the tip of hook portion 48, leaf spring 50 may be bent away from the tip of hook portion 48 for attaching and locking boat attachment hook 40 to auxiliary towline 18 shown in FIG. 1.

In operation, boat attachment hook 40, attached to boat 14 through auxiliary towline 18, essentially does not rotate, while circular plate 32 rotates about the longitudinal axis of shaft 46 in response to torque exerted by towlines 10 and 12. If towlines 10 and 12 are crossed and the lines are put in tension as during normal use, the opposite pulling forces applied by towline 10 to hole 32 and by towline 12 to hole 30 add to form a torque which is felt by circular plate 32 causing plate 32 to rotate in the direction of the applied torque to thereby uncross the tangled towlines. Similarly, skiers executing crossover maneuvers or exchanging lines generate pulling forces which act on plate 32 and cause it to rotate when a net torque develops. This translation of forces to plate 32 tends to prevent the lines from making contact and rapidly eliminates any line-crossing which may occur.

Rotation of individual towlines within their respective holes is possible because the sleeves are wider than their respective towlines, as mentioned previously. This rotating ability tends to prevent individual lines from winding up during trick skiing maneuvers where an individual line is rotated about its own axis without causing circular plate 32 to rotate, such as where two skiers pirouette without crossing over.

Slot 34 is narrower than sleeve 30 and slot 35 is narrower than sleeve 31, as stated previously. Thus, sleeves 30 and 31 are prevented from traveling through slots 34 and 35 respectively. Slots 34 and 35 are, however, each wider than a towline thus permitting a towline to pass through those slots. If it is desired to remove one towline, for example, towline 12, from towing device 16 to permit single skiing or to change lines, sleeve 30 may be pushed forwardly completely out of hole 61 in circular plate 32. and towline 12 may then be removed from plate 32 through slot 34. Towline 12 is inserted into circular plate 32 by first inserting the line itself through slot 34 and then sliding sleeve 30 into hole 61 until detent 60 catches.

While the invention has been illustrated and described in detail in the drawings and foregoing description, the same is to be considered as illustrative and not restrictive in character, it being understood that only the preferred embodiment has been shown and described and tht all changes and modifications that come within the spirit of the invention are desired to be protected.

What is claimed is:

1. A tandem water ski towing device for coupling first and second ski towlines to a ski boat, said towing device comprising a locking hook, said hook having a forward hook portion and a shaft extending rearwardly therefrom; and a towline carrier rotatably coupled to said shaft about the longitudinal axis of said shaft, said towline carrier including means for retaining the first and second towlines apart from each other in diametrically opposed positions with respect to said shaft, said shaft extending into said towline carrier to a point on a line between said towlines.

2. The tandem water ski towing device of claim 1 in which said towline retaining means defines first and second diametrically opposed holes, said first hole being wider than the first towline and said second hole being wider than the second towline.

3. The tandem water ski towing device of claim 2 in which said towline retaining means includes means for allowing the first and second towlines to rotate within said first and second holes respectively.

4. A tandem water ski towing device for coupling first and second ski towlines to a ski boat, said towing device comprising a locking hook, said hook having a forward hook portion and a shaft extending rearwardly therefrom; a plate coupled to said shaft, said plate being rotatable about an axis through the center of and perpendicular to said plate and about the longitudinal axis of said shaft, said plate including means for retaining the first and second towlines in separate positions on opposite ends of a line extending perpendicularly through said shaft.

5. The tandem water ski towing device of claim 4 in which said towline retaining means defines first and second diametrically opposed holes, said first hole being wider than the first towline and said second hole being wider than the second towline.

6. A tandem water ski towing device for coupling first and second ski towlines to a ski boat, said towing device comprising a boat attachment hook, said boat attachment hook including a forward hook portion for attachment to the boat, and a rearward shaft portion; a circular plate mounted on said rearward shaft portion of said boat attachment hook. said plate being rotatable about an axis through the center of and perpendicular to said plate and about the longitudinal axis of said rearward shaft portion, said plate defining a first hole which is radially displaced from the center of said plate, said plate further defining a second hole which is radially displaced from the center of said plate and diametrically opposed to said first hole; means for attaching a towline to said first hole; and means for attaching a towline to said second hole, said rearward shaft portion extending through the center of said plate to a point on a line between towlines attached to said first and second holes.

* * * * *